United States Patent [19]

Smith et al.

[11] 4,413,483

[45] Nov. 8, 1983

[54] CONTROL MECHANISM FOR CIRCULAR KNITTING MACHINE

[75] Inventors: William C. Smith; Gerald A. G. Seekings, both of Leicester, England

[73] Assignee: Bentley Engineering Company Limited, Leicester, England

[21] Appl. No.: 192,637

[22] Filed: Sep. 30, 1980

[30] Foreign Application Priority Data

Oct. 1, 1979 [GB] United Kingdom ..... 7933905

[51] Int. Cl.[3] ..... D04B 15/38; D04B 15/66

[52] U.S. Cl. ..... 66/125 R; 66/157; 66/237

[58] Field of Search ..... 66/125 R, 157, 231, 66/236, 237

[56] References Cited

U.S. PATENT DOCUMENTS

| | | | |
|---|---|---|---|
| 412,600 | 10/1889 | Cooper et al. | 66/237 X |
| 2,143,198 | 1/1939 | Lawson et al. | 66/237 X |
| 2,323,998 | 7/1943 | Hutton, Jr. et al. | 66/231 X |
| 3,169,384 | 2/1965 | Coile | 66/237 X |
| 3,218,830 | 11/1965 | Deans et al. | 66/237 X |
| 3,296,836 | 1/1967 | Billi | 66/138 |
| 3,469,422 | 9/1969 | Minton | 66/157 X |
| 3,774,417 | 11/1973 | Bini | 66/237 X |
| 3,896,638 | 7/1975 | Gottschall et al. | 66/157 X |
| 4,151,729 | 5/1979 | Micheletti | 66/231 X |
| 4,267,708 | 5/1981 | Chietti | 66/237 X |

FOREIGN PATENT DOCUMENTS

| | | | |
|---|---|---|---|
| 2119816 | 12/1971 | Fed. Rep. of Germany | 66/125 R |
| 2237712 | 7/1973 | Fed. Rep. of Germany | 66/125 R |
| 2303253 | 8/1973 | Fed. Rep. of Germany | 66/236 |
| 685690 | 1/1953 | United Kingdom | 66/237 |
| 652241 | 3/1979 | U.S.S.R. | 66/236 |

*Primary Examiner*—Wm. Carter Reynolds

*Attorney, Agent, or Firm*—Buell, Blenko, Ziesenheim & Beck

[57] ABSTRACT

The invention provides a circular knitting machine having a control mechanism with a rackable cam drum. A rackable timing drum carrying control elements for the speed of progress of the timing drum and activation of the cam drum racking, and a quick re-zeroing control for racking the cam drum quickly to a zero position independently of the control elements in which a racking means is arranged to rack the timing drum at every stroke with a length of stroke in excess of the timing drum racking strokes during normal knitting. A control member controls the racking means to inactivate it during normal knitting and activate it when re-zeroing so as to re-zero both the cam drum and the timing drum quickly while all knitting stations are inoperative.

7 Claims, 3 Drawing Figures

CONTROL MECHANISM FOR CIRCULAR KNITTING MACHINE

DESCRIPTION

1. Field of Invention

The invention relates to control mechanisms for circular knitting machines and to circular knitting machines incorporating such mechanisms. The control mechanisms are particularly suitable for so-called "seamless" knitting machines for knitting articles such as stockings, tights and pantie hose i.e. very fine plain fabric.

2. Background of the Invention

On circular knitting machines for knitting tights faults may occur in the course of knitting. This may involve a press-off. The machine then has to be re-zeroed before knitting can restart with a cam or program drum and timing chain or other timing device in the zero-position.

It is known to leave the chain and cam drum in synchronised relation and finish the prematurely terminated knitting cycle before restarting knitting. The operative may have to attend during this prolonged period in which no useful production occurs to ensure knitting is restarted properly.

The British Pat. No. 2,010,342, which corresponds to U.S. Pat. No. 4,267,708, describes a control mechanism with a cam drum which can be re-zeroed quickly. No means is provided for speeding up the timing drum racking so that the timing drum is racked at speed but still with variable intervals depending on the lay-out of pins on the timing drum.

The Billi U.S. Pat. No. 3,296,836 describes a mechanism for making all yarn feed stations inoperative simultaneously. Even with such mechanisms, the zeroing operation after the correction of a fault still requires considerable time.

It is a first object of the invention to improve the efficiency of circular knitting machines either by ensuring less time is used in re-zeroing after correction of a fault and/or reducing the amount of time an operative has to attend a machine on re-zeroing so enabling him to supervise a greater number of machines.

It is a second object of the invention to provide a constructionally simple control mechanism which can be manufactured from a small number of standard parts so reducing manufacturing and servicing costs.

SUMMARY OF INVENTION

According to the invention there is provided a circular knitting machine having a control mechanism for controlling knitting of an article on a needle cylinder, said control mechanism including a cam drum, a cam drum racking means, timing means and racking means for the timing means, means on the timing means for activating the cam drum racking means at predetermined intervals, means for making all yarn feed stations inoperative during the correction of a fault, in which the timing means includes a timing drum, the racking means for the timing drum is arranged to provide a different length or frequency of racking advance of the timing drum, article length control means are provided on the timing drum for controlling the length or frequency of racking advance so as to activate the cam drum at pre-programmed intervals and the racking means for the cam drum and timing drum include means for racking the cam drum and timing drum at a high speed compared to the speed during normal knitting after the correction of a fault, the high speed racking means being operative to return the timing drum and cam drum to their respective zero-positions independently of the article length control means whilst all the yarn feed stations are inoperative.

Preferably the racking means for the timing drum are arranged to provide different lengths of stroke and the racking means includes a pair of rackers having simultaneous strokes of different extent and the article length control means is arranged to selectively bluff the longest of the strokes. Both the timing drum itself and the racking means therefore can be of simple construction using a few standard parts particularly if the rackers are on a common pivotable lever but at different radii from the lever pivot and the timing drum is arranged to mount exchangeable control elements for controlling length or frequency of timing drum advance and activation of the cam drum.

It might be possible to use the same pawls used for the pre-programmed racking of the timing drum for a high speed advance of the timing drum, either by using a long stroke racker without interruption or by unbluffing a normally bluffed part of the racker stroke. Most simply and effectively however the racking means for the timing drum include a racker, not operative during normal knitting, for racking the timing drum at high speed and control means are provided for suspending the control of the timing drum over the cam drum racking means so as to rack the cam drum at a high frequency. The timing drum can thus be racked at speeds well in excess of the highest racking speeds for the cam drum even though the timing drum is normally racked at increments much smaller than those of the cam drum. Preferably then the high speed racker is arranged to be bluffed when the timing drum reaches the zero-position, and means are provided on the control drum for restoring the control of the timing means over the cam drum racking means when the cam drum passes through the zero-position and means are provided for arresting the knitting machine in the event that the cam drum passes through the zero-position when the timing drum has not yet reached the zero-position. Thus one extra pawl and bluffing means for it in the zero-position, are virtually all that is necessary to provide a high speed zeroing mode. The high speed zeroing of the timing drum permits the cam drum to be racked at every stroke so drastically reducing the zeroing time. In fact conveniently the high speed racker and the normal rackers for the timing drum are mounted on the same lever. A cam drum racker may also be mounted on that lever. The cam drum racker and the normal rackers for the timing drum are clawkers pulling their respective rackwheels, and the high speed timing drum racker is a pawl pushing its rackwheel and the control means include links for making the push pawl effective, bluffing the clawkers for the timing drum and disconnecting the activation means for the cam drum racking means so further simplifying the resultant construction. The use of clawkers permits a simple control mechanism requiring little additional space.

The cam drum can operate on levers whose cable mounting ends tip away from the cylinders so reducing the length of control cable required.

The overall control can also be simplified, facilitating the operator's tasks. Conveniently manual control means are provided for simultaneously making all yarn feed stations inoperative and activating the high speed racking of the timing drum and cam drum, and knitting machine operated control means are provided for making the yarn feed stations operative and deactivating the high speed racking to enable knitting to resume. Preferably the manual control means is latched in position after its operation and the cam drum has a means for unlatching the manual control means as the cam drum reaches the zero position. Thus the various control functions can be executed by operation of a single handle, reducing the risk of error on the part of the operator. Separate of the control means, there may be other control means to permit knitting without racking or manual cam drum adjustment.

Using the invention an operative can easily deal with any faults at the knitting head on changing to the zeroing mode after the machine has been stopped. After dealing with any fault, all the operative has to do is to re-engage the knitting machine which will then zero itself quickly and start a subsequent article without the operative's assistance.

DRAWINGS

DESCRIPTION OF SPECIFIC EMBODIMENT

Figure 1:
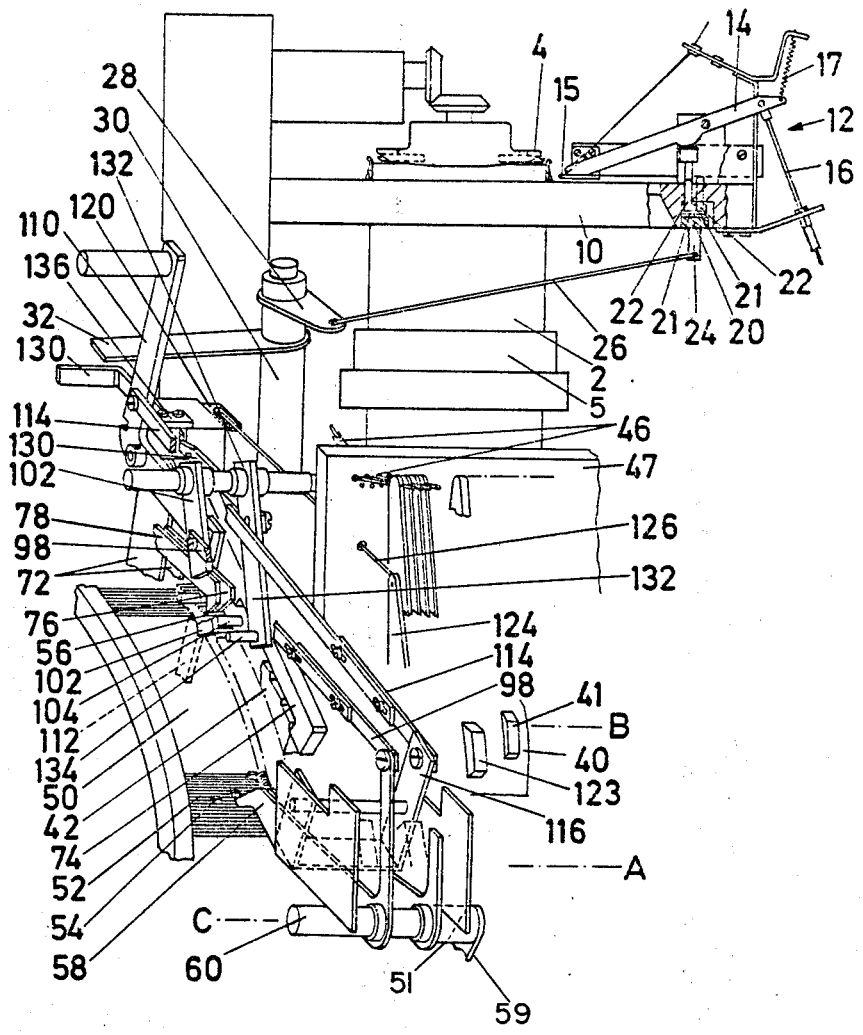
FIG. 1 shows a partial perspective view of a circular knitting machine according to the invention.

A circular knitting machine (FIG. 1) has a cylinder 2 for needles and a dial 4 and an associated cam system shown schematically at 5. A feeder mounting plate 10 surrounds the cylinder 2 and supports four feed stations 12, each carrying four feeders 14 and a throat plate 15, the feeders being pivotable into and out of an operative position during normal knitting by cables 16 and springs 17. The plate 10 mounts a ring 20 internally. Cams 21 on the ring 20 can raise rods 22 to lift the feeders 14 and throat plates 15 at every feed station 12. Once lifted, the feeders 14 cannot feed yarn to the needles whatever the condition of the cables 16 and are thus inoperable. The ring 20 is turned by pin 24 through a link 26 pulled by a lever 28 on a pivot post 30. The lever 28 is actuated by an arm 32. With the feeders 14 lifted, knitting cannot proceed. As soon as the ring 20 is turned back, the springs 17 lower one of the feeders 14 selected by the cables 16 at each station 12 into an operative feeding position. Knitting can then be resumed.

Figure 2:
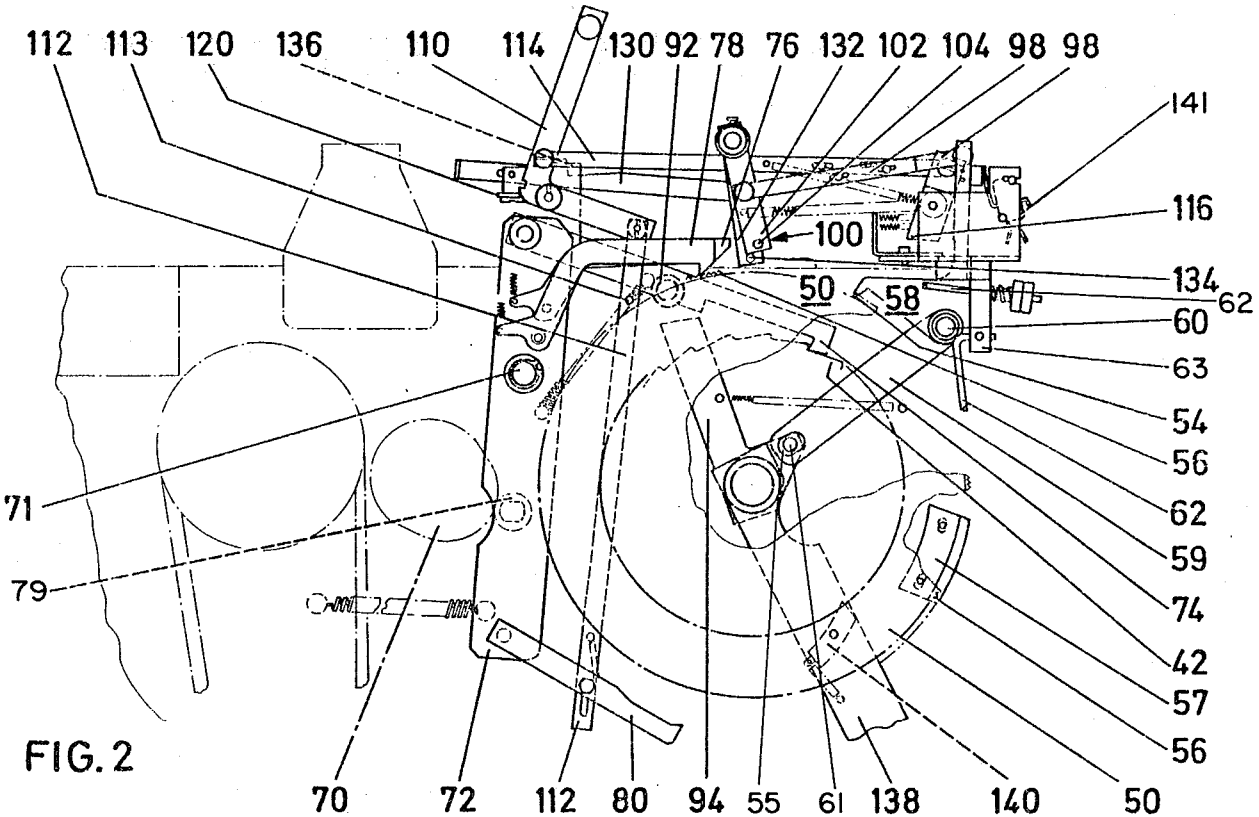
FIG. 2 shows a side view of a control mechanism of the circular knitting machine of FIG. 1.
Figure 3:
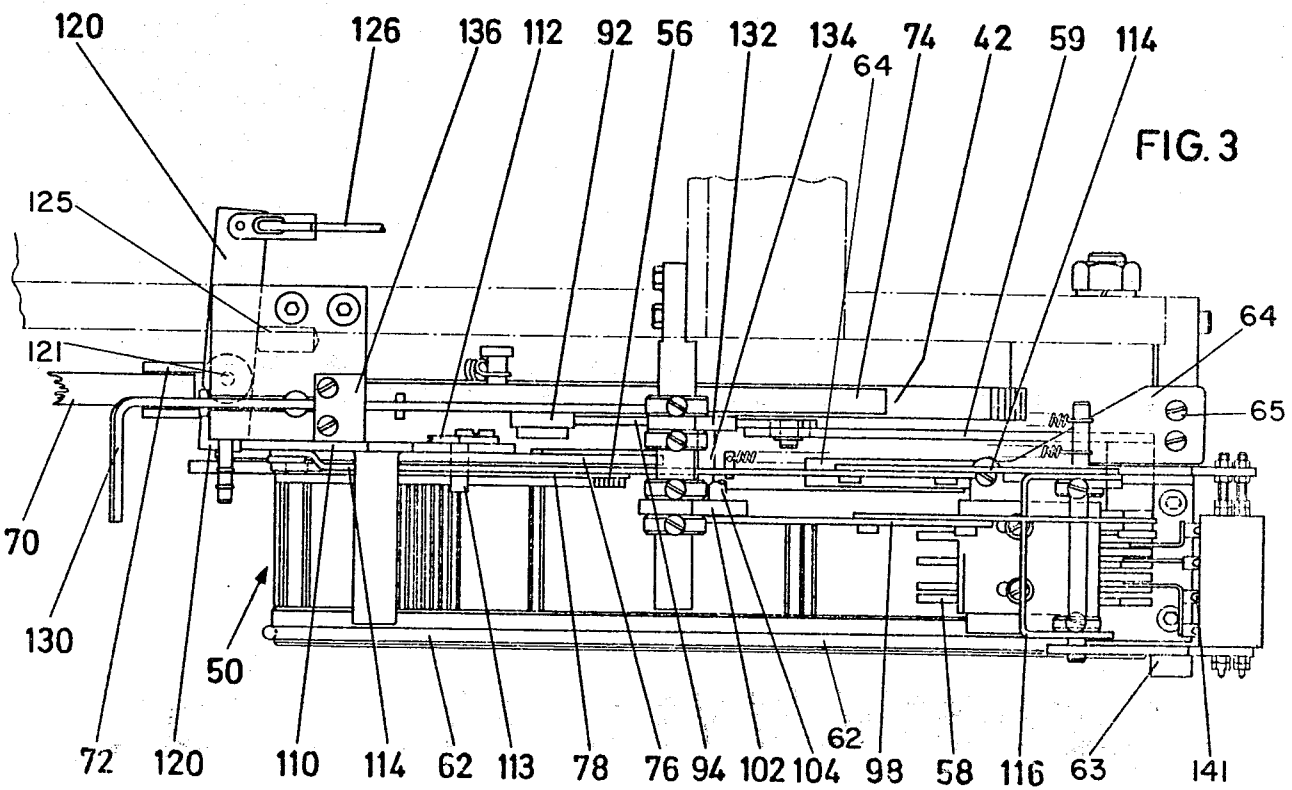
FIG. 3 shows a top view of the control mechanism of FIG. 2.

In front of the cylinder 2 as shown in FIG. 1 (which shows the rear of the knitting machine) there is mounted a cam drum 40 with cams 41 and a timing drum 50 with control elements 54 in slots 52 for rotation about a horizontal axis A. The cams 41 turn followers mounted for pivoting about pivot axis B. The followers operate cables 46 supported by plate 47. The control elements 54 can pivot followers 58 about pivot axis C formed by a shaft 60. The cam drum 40 is fast with a rack wheel 42 of a cam drum racking mechanism and the timing drum is fast with a rackwheel 56, the cam drum 40 together with its associated rackwheel 42 on the one hand and the timing drum 50 and its respective rackwheel 56 on the other hand being independently movable. The rackwheels 42 and 56 lie adjacent one another between the cam drum 40 and the timing drum 50. The timing drum is restrained by a brake wire 62, part of which is shown in FIG. 2, adjustably mounted by a bracket 63 and passing through an annular groove in a rim of the timing drum (see FIG. 3). A plate 64 prevents movement of the rackwheel 56 contrary to its direction of normal movement by being resiliently biased towards the rackwheel to engage in its teeth. The plate 64 is secured by screws 65.

The rackwheels 42 of a cam drum racking mechanism and 56 of a time drum racking mechanism can be actuated as follows (see FIG. 2). A cam 70 having a single lobe is revolved once every four cylinder revolutions and reciprocates a lever 72 on a pivot 71. The lever 72 has a pair of spaced members mounting a cam follower roller 78. The overall arrangement is such that this single lever mounts all the rackers provided in the control mechanism of the knitting machine. A clawker 74 of a cam drum racking mechanism for the cam drum 40 is mounted such a distance from the pivot 71 as to give the required stroke to advance the rackwheel 42 by one tooth pitch. A clawker 76 for the timing drum 50 is mounted between the clawker 74 and the pivot 71 at such a radial position as to give a stroke for advancing the rackwheel 56 by three pitches. The pitches of rackwheel 42 are much bigger than the pitches of rackwheel 56. As the clawker 74 is at a larger radius and acts on a smaller rackwheel 42, the angular displacements of the respective rackwheels by operation of the clawkers 74 and 76 differ considerably. The rackwheel 42 has twentyfour teeth and can be racked around in a corresponding number of steps. The rackwheel 56 has two hundred and eighty-eight teeth and can be racked in 96 steps. A clawker 78 is mounted between the clawker 76 and the pivot so as to rack the rackwheel 56 by one pitch. A push pawl 80 is mounted below the timing drum 50 at a large radius and is capable of advancing the rackwheel 56 twenty pitches in one step. All rackers are operative during the same reciprocation of the lever 72.

The various rackers 74, 76, 79 and 80 can be controlled to apply them to the respective rackwheels 42 and 56 as follows (see FIGS. 1 and 2). One of the followers 58 is pivotable jointly with an arm 59 (see FIG. 1) about the shaft 60. The respective follower 58 is connected by a sleeve 51 to the arm 59. The arm 59 has a slot 55 (FIG. 2). The slot 55 retains as roller 61 on a bell crank 94 pivotable about axis A. One arm of the Bell crank 94 can be located under a roller 92 on the cam drum clawker 74 to bluff it. Whenever a butt of the control elements 54 locates under the appropriate follower 58, the clawker 74 will be unbluffed and rack the rackwheel 42. Another follower 58 is pivotable about the shaft 60 and has an arm connected to a link 98 which operates a bluffer 100 having a pivotable arm 102 and a pin 104. The pin 104 can pivot under the nose of the clawker 76 to bluff it. Whenever a butt of the control elements 54 locates under the appropriate follower, the pin 104 will be withdrawn to unbluff the clawker 76 and rack the rackwheel 56 three pitches. The clawker 78 is not bluffed from the timing drum. The rackwheel 56 will thus be racked by a single pitch whenever the action of the clawker 78 is not overridden by the clawker 76.

Other followers 58 pivotable about shaft 60 perform different functions such as the detection of the timing drum zero position, the knitting speed control, quality (stitch length) control and any other appropriate functions.

A manually operable lever 110 (see FIG. 2) is provided to participate in changing the mode in which the control mechanism is racked. This L-shaped lever 110 is connected to a link 112 arranged parallel to the lever 72 which brings the push pawl 80 into and out of action. The link 112 carries a pin 113 which bluffs the clawkers 78 and 76 whenever the push pawl 80 is brought into action. The lever 110 is also connected by a link 114 to a U-bracket 116. When the push pawl 80 is brought into action, the U-bracket 116 tips all the followers 58 to a high position where they are not effected by the control elements 54. The tipping results in a permanent unbluffing of the cam drum clawker 74. The lever 110 also operates the actuating arm 32 to make all feeders inoperable.

The lever 110 can be held in one end position (in which the push pawl 80 is operative) by a spring catchplate 120. The cam drum mounts a cam 123 which through a follower 124 and cable 126 pivots the catchplate 120 about pivot 121 to release the lever 110. The catchplate 120 is urged by a sprung plunger at 125 to the other end position. The lever 110 is spring urged to a position in which the push pawl 80 is inoperative, i.e., the position illustrated in FIG. 2. In addition there is a manually slidable arm 130 overlying the catch plate 120 for pivoting an arm 132 carrying a pin 134 for bluffing both clawkers 76 and 78. The arm 130 has a recess for latching behind a plate 136. Thus the timing drum 50 can be arrested whilst knitting proceeds.

Operation

During normal knitting, the cylinder 2 and dial 4 revolve and selected feeders 14 are lowered to supply yarn to the needles. The clawkers 76 and 78 will advance the drum. Where longer delays are desired between successive racks of the cam drum 40, the operative changes control elements in the drum to make the pawl 76 ineffective. In this way the length of the article knitted can be changed within wide limits without altering the peripheral extent of the timing drum 50. The drum 50 may have an indicator scale to enable appropriate control elements 54 to be readily located.

When required, a suitable control element 54 activates the cam drum clawker. When an article has been knitted, both the cam drum 40 and the timing drum 50 have re-zeroed back to the start position so that knitting of the next article can commence without interruption. Generally speaking the control elements 54 are arranged to either activate the pawl 76 where required or to activate the cam drum clawker, the cam drum clawker being preferably activated during a short timing drum rack.

In the course of knitting, a fault may occur which has to be remedied by an operative. For example a needle can start to malfunction so that it has to be replaced. The mechanic or operative then stops the machine. The machine can also stop automatically when a stopmotion is operated. After stopping of the knitting machine, the operative moves the lever 110 from the position shown in FIG. 2 (which illustrates the normal knitting mode of operation) to the other end position where the plate 120 secures the lever 110. As a result the throatplate 15 and any active feeders 14 are lifted giving access to the knitting zone. The operative can then make ay corrections required and then restart the knitting machine. Further operative supervision is then no longer necessary. The control mechanism is now in a re-zeroing mode with pawl 80 active, clawkers 76 and 78 bluffed and the clawker 74 constantly activated. The pawl 80 will now re-zero the timing drum 50 and move it approximately at twice the speed at which the clawker 74 racks the cam drum 40. The zero-position is held by a bluff plate 57 fastened to the rackwheel 56 which plate 57 just bluffs twenty pitches of the rackwheel 56. Thus as the timing drum reaches the zero position it is arrested and cannot be racked further. As the pawl 80 racks by twenty pitches at a time, it can be seen that the final rack is likely to be an incomplete rack with an initial part of the stroke of the pawl 80 bluffed. Whatever the time at which the lever 110 is operated however, the rackwheel 56 will always settle at the same zero position in which the plate 57 bluffs the whole of the stroke of the pawl 80 to the extent of twenty pitches, no more and no less.

After the timing drum 50 has been arrested (and the zero position will be reached very quickly), the cam drum 40 continues to be racked at every revolution of the cam 70. The control elements 54 are ignored and do not interfere with the quick return of the cam drum 40 to the zero position. At the zero position, the cam 123 causes the catchplate 120 to release the lever 110, deactivating the pawl 80 and re-activating the control mechanism for normal knitting. Release of the lever 110 also restores the feeders 14 to their normal control and the cam drum 40 will be racked under control of the appropriate follower 58.

When remedying a fault or when checking certain controls, the operative may rack the cam drum 40 by hand using the hand racking lever 138 and pawl 140. Consequently the cam drum 40 may be advanced ahead of its normal, synthronized position with respect to the timing drum 50. The higher speed of the timing drum 50 in the re-zeroing mode can then be insufficient to overtake the cam drum 40. The cam drum 40 could then trigger normal knitting before the timing drum 50 has been properly zero-ed. For this purpose a microswitch 141 is operated by a butt on the timing drum 50 only at the zero position and a similarly arranged switch detects the zeroing of the cam drum 40. The switches are connected so that the drive motor for knitting is stopped unless both microswitches are operated indicating proper re-zeroing. Should the knitting machine stop for this reason, an audio or visual warning can be given to alert the operator to the need to re-synchronise the timing drum 50 and the cam drum 40.

In this event, the operative pulls the lever 110 and starts the knitting machine once more in the zeroing mode. This time, the timing drum 50 will definitely zero ahead of the cam drum 40 and knitting is resumed in due course.

The time taken by operatives to supervise or effect re-zoning after fault finding can be reduced. The operative need not stay with the machine until it is re-zeroed and need not himself initiate the normal knitting mode. Except in extreme circumstances, re-zeroing and re-synchronisation is automatic. Re-zeroing is effected quickly.

The different modes of operation are provided by a relatively simple mechanism which also permits the usual timing chain to be omitted. Only one kind of control element 54 need be stocked. The butts which are not desired can be broken off.

In some kinds of knitting many control drum racks may occur close together early on in the cycle. The timing drum would then not have reached the zero position by the time the control drum does if re-zeroing is initiated after those control drum racks have been taken. In such a case a manually initiated second re-zero cycle could be initiated as discussed above. Alternatively the number of increments racked by the fast racker pawl 80 may be increased. For example the racker 80 may be pivoted concentrically with the timing drum and be reciprocated by an appropriate link or push arm to the lever 72. Thus the mechanism can be adapted to operate advantageously even where the knitting pattern would cause a larger number of early control drum racks.

We claim:

1. Circular knitting machine having a needle cylinder, a cam system surrounding the cylinder, needles in the cylinder operable by the cam system, yarn feeders for supplying yarn to the needles for knitting, a cam drum, cams on the cam drum, a cam drum racking mechanism, a control means for selectively activating the cam drum racking mechanism with predetermined interruptions, wherein said control means includes a timing drum, control elements mounted on said timing drum for controlling activation of the cam drum racking mechanism, a rackwheel rotatable with the timing drum, a racking lever, a pivot mounting the racking lever at a position intermediate its ends a small increment racking means pivotably mounted on the lever for engaging the rackwheel on one side of the pivot mounting at a small radius to thereby rack the timing drum at increments smaller than the increments with which the cam drum racking mechanism racks the cam drum, a larger increment racker pivotably mounted on the lever for engaging the rackwheel on the other side of the pivot mounting at a larger radius than the small increment racking means to thereby rack the timing drum at increments larger than the increments with which the cam drum racking mechanism racks the cam drum, a manually operable control member to activate the large increment racker, to cause the yarn feeders to cease supplying yarn to the needles for knitting and to override the control means so that the cam drum racking mechanism operates without interruption to enable the cam drum and timing drum to be zeroed.

2. Circular knitting machine as claimed in claim 1 in which the small increment racking means comprises a pair of small increment rackers mounted at different radii on said one side of the pivot mounting to provide simultaneous strokes of different extent on the rack wheel of the timing drum and in which the control elements of the timing drum act on bluffing means for the cam drum racking mechanism and on a bluffing means for one of the timing drum racking mechanisms to control which of the respective small increment rackers is operative to advance the timing drum to thereby permit the duration of the predetermined interruptions to be varied.

3. Circular knitting machine as claimed in claim 1 in which means are associated with the rackwheel for bluffing the whole stroke of the large increment racker when the timing drum is in the zero position, and means are mounted on the cam drum for re-setting the manually operable control member restart knitting under control of the cam drum and timing drum when the cam drum is racked through the zero position.

4. Circular knitting machine as claimed in claim 3 in which a latching mechanism holds the manually operable control member in position when operated and the resetting means are a means for unlatching the control member.

5. Circular knitting machine as claimed in clam 3 in which means are provided to arrest the knitting machine in the event that the cam drum reaches the zero-position before the timing drum.

6. Circular knitting machine as claimed in claim 1 in which the small increment racking means include a clawker pulling the rackwheel and the large increment racker is a pawl pushing the rackwheel.

7. Circular knitting machine as claimed in claim 1 in which means are provided for preventing racking of the timing drum by the small increment racking means without interrupting operation of the feeders.

* * * * *